US006382145B2

(12) United States Patent
Matsuda

(10) Patent No.: US 6,382,145 B2
(45) Date of Patent: May 7, 2002

(54) REED VALVE COOLING APPARATUS FOR ENGINE

(75) Inventor: Yoshimoto Matsuda, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 09/760,817

(22) Filed: Jan. 17, 2001

(30) Foreign Application Priority Data

Jan. 18, 2000 (JP) ..... 2000-008852

(51) Int. Cl.[7] ..... F01P 1/06
(52) U.S. Cl. ..... 123/41.31; 123/73 V
(58) Field of Search ..... 123/41.31, 73 V

(56) References Cited

U.S. PATENT DOCUMENTS 4,387,565 A * 6/1983 Otani et al. ..... 60/293
4,901,682 A * 2/1990 Everts ..... 123/73 V

FOREIGN PATENT DOCUMENTS

JP 8-74687 A 3/1996

* cited by examiner

*Primary Examiner*—Tony M. Argenbright
*Assistant Examiner*—Katrina B. Harris
(74) *Attorney, Agent, or Firm*—Oliff & Berridge, PLC

(57) ABSTRACT

A reed valve is fitted in an intake port member formed on a crankcase of an engine and the flange of the reed valve is placed between the respective joining surfaces of the intake port member and an intake manifold. A water jacket is formed in a circumferential wall of the intake port member or the intake manifold, or water jackets are formed on both the intake port member and the intake manifold to cool the reed valve by cooling water for a forced cooling. When the water jacket is formed on the intake port member, a gasket of a metal is placed between the joining surface of the intake port member and the flange of the reed valve. The reed valve cooling apparatus can effectively cool the reed valve with cooling water.

18 Claims, 7 Drawing Sheets

REED VALVE COOLING APPARATUS FOR ENGINE

BACKGROUND OF THE INVENTION

1. Field of the Invention

The present invention relates to a reed valve cooling apparatus for an internal-combustion engine and, more particularly, to a reed valve cooling apparatus for an injector type engine to be mounted on a small planing boat.

2. Description of the Related Art

Referring to FIG. 8 showing a direct injection two-cycle engine provided with a reed valve in a vertical sectional view, an injector 14 is attached to a cylinder head 20 so as to inject fuel into a combustion chamber 21, and an intake port member 29 is formed integrally with a crankcase 18 so as to project diagonally upward from the crankcase 18. A reed valve 31 is fitted in the intake port member 29. The reed valve 31 has a flange 36 which is held between the joining surface 37 of the intake port member 29 and the joining surface 38 of an intake manifold 30. The intake manifold 30 is fastened to the intake port member 29 with bolts 42. A throttle body 43 provided with a throttle valve 44 is joined to the upper end of the intake manifold 30, and an air intake case 45 is connected to the throttle body 43.

The reed valve 31 has a valve case 32 of aluminum integrally provided with the flange 36, reeds 34 each having one end fixed to the base end of the valve case 32, and stoppers 35 of a metal for limiting the opening of the reeds 34. A heat insulating gasket 140 of, for example, paper is placed between the joining surface 37 of the intake port member 29 and the flange 36 of the reed valve 31.

The heat insulating gasket 140 is placed between the joining surface 37 of the intake port member 29 and the flange 36 of the reed valve 31 to retard conduction of heat from the engine to the reed valve 31. However, in some cases, it is difficult to prevent temperature rise in the reed valve 31 through heat insulation only by the heat insulating gasket 140. For example, in the direct injection type engine provided with the injector 14 as shown in FIG. 8 and not provided with any carburetor, the effect of fuel (air-fuel mixture)on cooling the reed valve 31 cannot be expected and hence it is difficult to prevent temperature rise in the reed valve 31. If the reed valve 31 is heated by heat transferred thereto by heat conduction or heat radiation, the strength of the reeds 34 is reduced. The strength of the reeds 34 can be increased by increasing the thickness of the reeds 34, which, however, deteriorates the response characteristic of the reeds 34.

SUMMARY OF THE INVENTION

Accordingly, it is an object of the present invention to provide a reed valve cooling apparatus capable of performing a forced cooling of a reed valve of an internal-combustion engine in order that the reed valve has satisfactory response characteristic and sufficient strength.

According to a first aspect of the present invention, a reed valve cooling apparatus for cooling a reed valve fitted in an intake port member formed on a crankcase of an internal-combustion engine, the reed valve having a flange placed between a joining surface of the intake port member and a joining surface of an intake pipe, the reed valve cooling apparatus includes:a water jacket formed in a circumferential wall of the intake port member; and a highly heat-conductive gasket placed between the joining surface of the intake port member and the flange of the reed valve.

Heat transferred from the crankcase to the intake port member can be dissipated by cooling water circulating through the water jacket. The reed valve can be effectively cooled by conduction of heat from the reed valve through the highly conductive gasket to the intake port member.

Preferably, the reed valve cooling apparatus further includes: a water jacket formed in a circumferential wall of the intake pipe; and a highly heat-conductive gasket placed between the joining surface of the intake pipe and the flange of the reed valve.

Both the intake port member and the intake pipe can be cooled. The reed valve can be cooled by conduction of heat from the reed valve through the highly conductive gaskets to the intake port member below the reed valve with respect to an air intake direction and from the reed valve to the intake pipe above the reed valve with respect to the air intake direction.

Preferably, the engine is provided with an injector disposed at a position above the reed valve with respect to a flowing direction of an intake air or on a cylinder head.

Preferably, the engine is adapted to be installed on a craft for traveling on a water; and a cooling water for the water jacket is supplied from an ambient water.

According to the second aspect of the present invention, a reed valve cooling apparatus for cooling a reed valve fitted in an intake port member formed on a crankcase of an internal-combustion engine, the reed valve having a flange placed between a joining surface of the intake port member and a joining surface of an intake pipe, the reed valve cooling apparatus includes: a water jacket formed in a circumferential wall of the intake pipe; a highly heat-conductive gasket placed between the joining surface of the intake pipe and the flange of the reed valve; and a heat-insulating gasket placed between the joining surface of the intake port member and the flange of the reed valve.

The intake pipe can be effectively cooled. The reed valve can be cooled by conduction of heat from the reed valve through the highly conductive gasket to the intake pipe. Heat conduction from the intake port member to the reed valve can be effectively retarded by the heat-insulating gasket.

Preferably, the engine is provided with an injector disposed at a position above the reed valve with respect to a flowing direction of an intake air or on a cylinder head.

Preferably, the engine is adapted to be installed on a craft for traveling on a water; and a cooling water for the water jacket is supplied from an ambient water.

According to the third aspect of the present invention, an internal-combustion engine includes: a crankcase; an intake port member formed on the crankcase, the intake port member having a circumferential wall and a joining surface; an intake pipe joined to the intake port member, the intake pipe having a circumferential wall and a joining surface; a reed valve fitted in the intake port member, the reed valve having a flange placed between the joining surface of the intake port member and the joining surface of the intake pipe; and a reed valve cooling apparatus having a water jacket formed in the circumferential wall of the intake port member and a highly heat-conductive gasket placed between the joining surface of the intake port member and the flange of the reed valve.

Preferably, the reed valve cooling apparatus further includes: a water jacket formed in the circumferential wall of the intake pipe; and a highly heat-conductive gasket placed between the joining surface of the intake pipe and the flange of the reed valve.

Preferably, the internal-combustion engine further includes:

a cylinder head; and an injector disposed at a position above the reed valve with respect to a flowing direction of an intake air or on the cylinder head.

Preferably, the engine is adapted to be installed on a craft for traveling on a water; and a cooling water for the water jacket is supplied from an ambient water.

According to the fourth aspect of the present invention, an internal-combustion engine includes: a crankcase; an intake port member formed on the crankcase, the intake port member having a circumferential wall and a joining surface; an intake pipe joined to the intake port member, the intake pipe having a circumferential wall and a joining surface; a reed valve fitted in the intake port member, the reed valve having a flange placed between the joining surface of the intake port member and the joining surface of the intake pipe; and a reed valve cooling apparatus having a water jacket formed in the circumferential wall of the intake pipe; a highly heat-conductive gasket placed between the joining surface of the intake pipe and the flange of the reed valve; and a heat-insulating gasket placed between the joining surface of the intake port member and the flange of the reed valve.

Preferably, the internal-combustion engine further includes:

a cylinder head; and an injector disposed at a position above the reed valve with respect to a flowing direction of an intake air or on the cylinder head.

Preferably, the engine is adapted to be installed on a craft for traveling on a water; and a cooling water for the water jacket is supplied from an ambient water.

When an internal-combustion engine has an injector disposed at a position above the reed valve with respect to a flowing direction of an intake air or in the cylinder head, only air or air containing a small amount of oil flows through the reed valve and the cooling effect of fuel cannot be expected. However, the reed valve cooling apparatus of the present invention can cool the reed valve using cooling water with a result that temperature rise in the reed valve can be effectively suppressed. Therefore, the reed valve can be provided with a strong reed having a satisfactory response characteristic.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

First Embodiment

Figure 1:
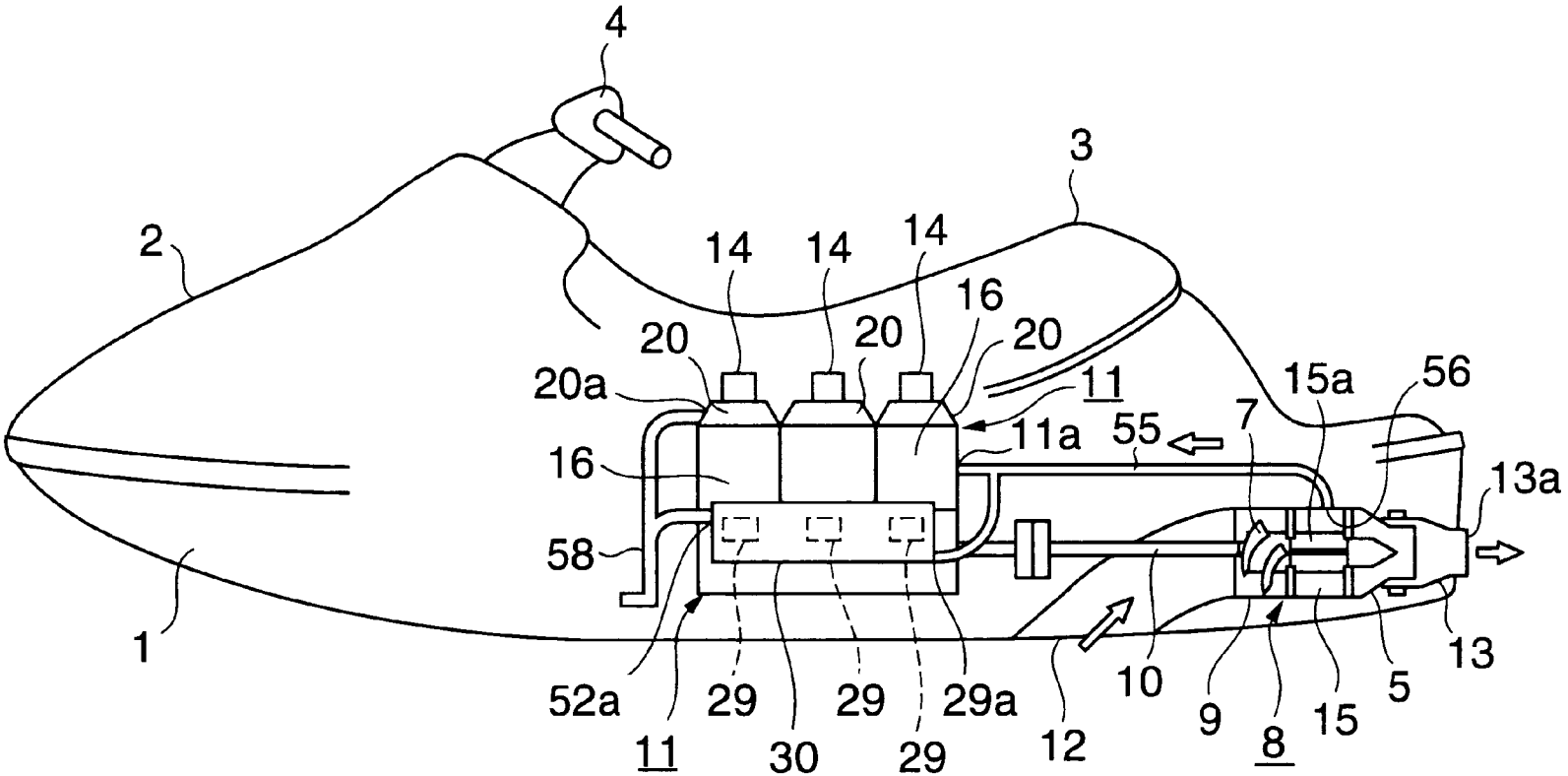
FIG. 1 is a transparent side elevation of a small planing boat mounted with an engine having a reed valve cooling apparatus in a first embodiment according to the present invention.

FIG. 1 shows a small planing boat mounted with an internal-combustion engine having a reed valve cooling apparatus in a first embodiment according to the present invention. The small planing boat has a body having a hull 1 and a deck 2. A saddle seat 3 and a handlebar 4 are supported on the deck 2. A water-jet propulsion unit 8 is disposed in a rear portion of the hull 1. The water-jet propulsion unit 8 includes a duct 9, guide vanes (current plates) 15, a jet nozzle 5 and an impeller 7. A laterally swingable steering nozzle 13 is disposed behind the jet nozzle 5. The impeller 7 is housed in the duct 9 and is mounted on an impeller shaft (drive shaft) 10. The impeller shaft 10 is coupled with the output shaft of an engine 11. A rear end portion of the impeller shaft 10 is supported for rotation in a bearing housed in a bearing case 15*a* held on the guide vanes 15. When the impeller 7 is rotated, water is sucked through an water intake 12 formed in the bottom of the hull 1 into the duct 9, flows through the guide vanes 15 and the jet nozzle 5 and is jetted out through the rear end opening 13*a* of the steering nozzle 13.

The engine 11 is a three-cylinder two-cycle direct injection engine and is installed in an engine room formed under the seat 3. The engine 11 has cylinder heads 20 respectively provided with injectors (fuel injection valves) 14.

A cooling water inlet 56 opens into the jet nozzle 5 of the water-jet propulsion unit 8 and is connected to a cooling water inlet 11*a* of the engine 11 and the cooling water inlets 29*a* of water jackets for cooling intake port members 29 by a cooling water pipe 55. A cooling water discharge pipe 58 is connected to the outlet 20*a* of a water jacket for cooling the cylinder heads 20 and the outlet 52*a* of a water jacket for cooling an intake manifold (an example of an intake pipe) 30. Water used for cooling is discharged outside the boat through the cooling water discharge pipe 58.

Figure 2:
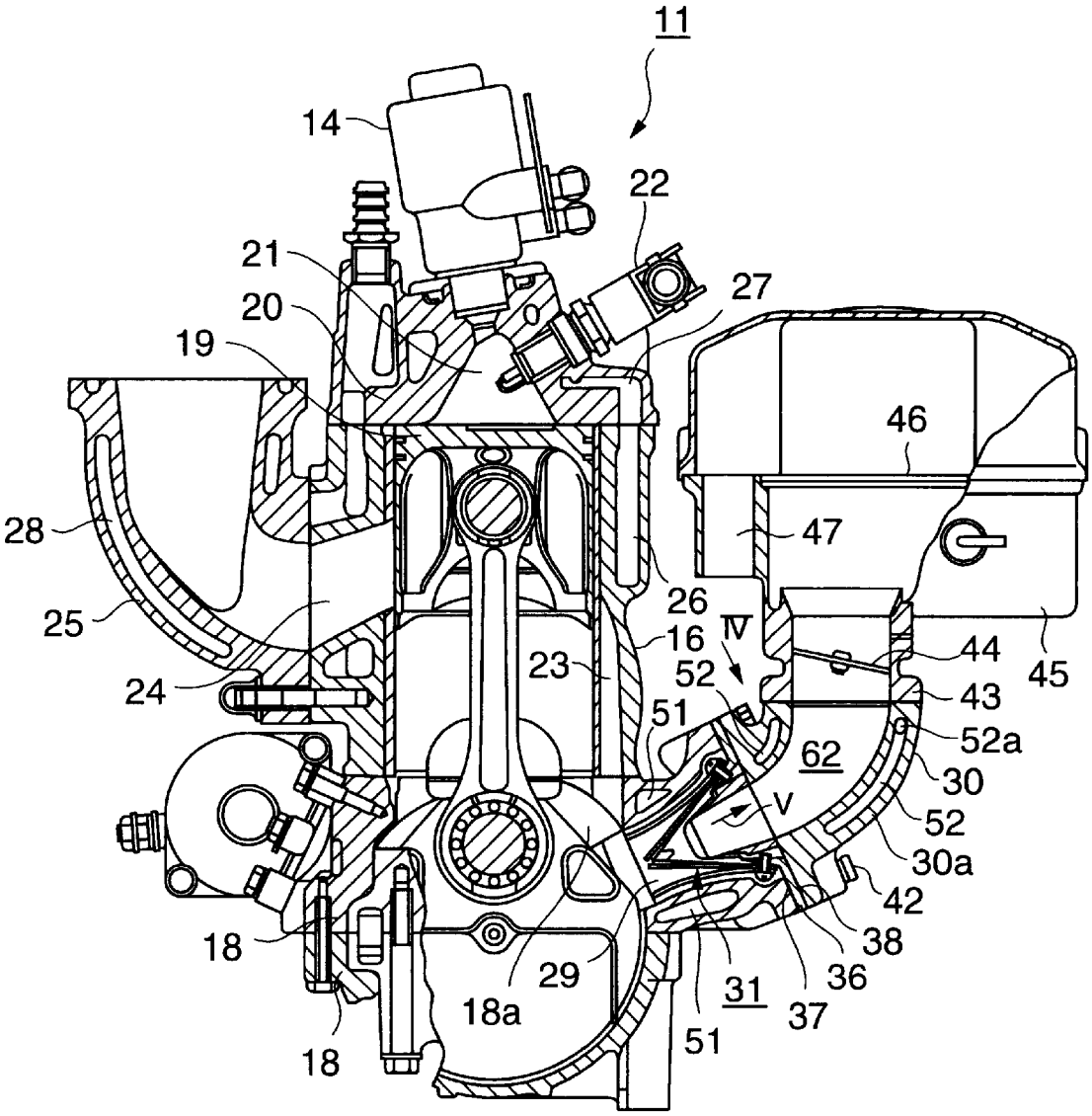
FIG. 2 is vertical sectional view of the engine shown in FIG. 1.

Referring to FIG. 2 showing one of the cylinders 16 of the engine 11, the cylinder head 20 is fastened to the upper end of the cylinder 16, and a crankcase 18 is fastened to the lower end of the cylinder 16. The cylinder head 20 defines a combustion chamber 21. A water jacket 27 is formed on the cylinder head 20. The injector 14 and a spark plug 22 are mounted on the cylinder head 20. The injector 14 is attached to an upper portion of the cylinder head 20 and is connected through a fuel pump to a fuel tank (not shown).

A piston 19 is fitted in the cylinder bore of the cylinder 16. The cylinder 16 is provided with an exhaust port 24, a scavenging passage 23 and a water jacket 26. An exhaust manifold 25 is connected to the exhaust port 24. The scavenging passage 23 opens into the cylinder bore and is connected to a crank chamber 18*a* in the crankcase 18. The water jacket 26 communicates with the water jacket 27 of the cylinder head 20 and a water jacket 28 formed on the exhaust manifold 25.

An intake port member 29 is formed on the crankcase 18 on one side of the engine 11 opposite to a side on which the exhaust port 24 is formed in the cylinder 16. The intake port member 29 projects obliquely upward from the crankcase 18. A reed valve (valve assembly) 31 is placed in the intake port member 29. The reed valve 31 has a flange 36 held between the joining surface 37 of the intake port member 29 and the lower joining surface 38 of the intake manifold 30. The intake manifold 30 is fastened to the intake port member 29 by bolts 42. A throttle body 43 internally provided with a throttle valve element 44 is connected to the upper end of the intake manifold 30, and an air intake case 45 provided with a flame arrester 46 and an air inlet 47 is connected to the upper end of the throttle body 43.

Figure 3:
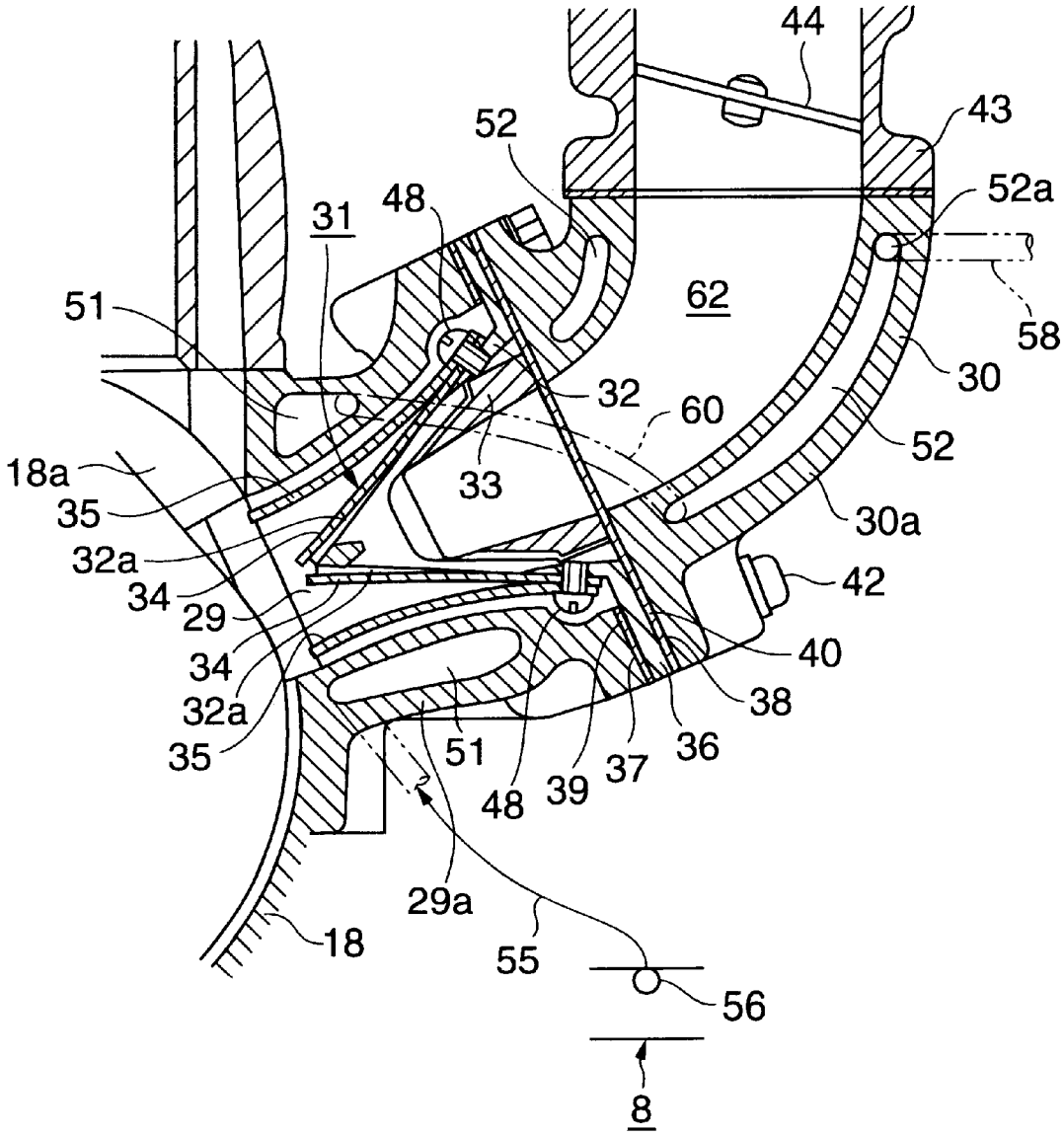
FIG. 3 is an enlarged vertical sectional view of a reed valve portion included in the engine shown in FIG. 2.

Referring to FIG. 3, the reed valve 31 includes a valve case 32 integrally provided with the flange 36 and having a sectional shape resembling an isosceles triangle, reeds 34 of a resin, stoppers 35 of a metal for defining a maximum opening of the reeds 34, and an inner case 33. The valve case 32 is provided with openings 32*a* normally covered with the reeds 34. Upper end portions of the reeds 34 and the stoppers 35 are fastened to the valve case 32 with bolts 48.

The water jacket 51 and a water jacket 52 are formed in respective circumferential walls 29*a* and 30*a* of the intake port member 29 and the intake manifold 30 so as to surround the respective inner surfaces of the intake port member 29 and the intake manifold 30. The lower end of the water jacket 51 for the intake port member 29 is connected to the cooling water inlet 56 of the water-jet propulsion unit 8 by the cooling water pipe 55. The upper end of the water jacket 52 for the intake manifold 30 is connected to the cooling water discharge pipe 58. The water jacket 51 for the intake port member 29 and the water jacket 52 for the intake manifold 30 communicate with each other by means of a connecting pipe 60.

Figure 4:
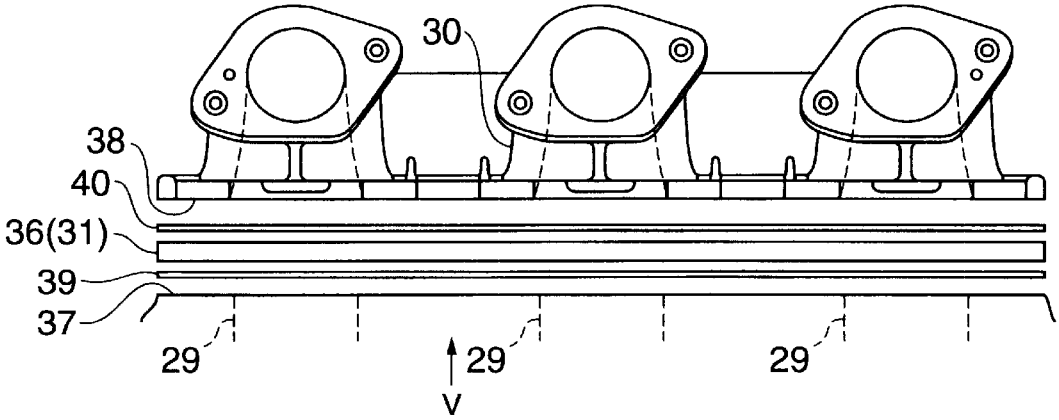
FIG. 4 is an exploded view taken in the direction of the arrow IV in FIG. 2.

Referring to FIG. 4, a gasket 39 of a highly heat-conductive metal is held between the joining surface 37 of the intake port member 29 and the flange 36 of the reed valve 31. A gasket 40 of a highly heat-conductive metal is held between the lower joining surface 38 of the intake manifold 30 and the flange 36 of the reed valve 31.

Figure 5:
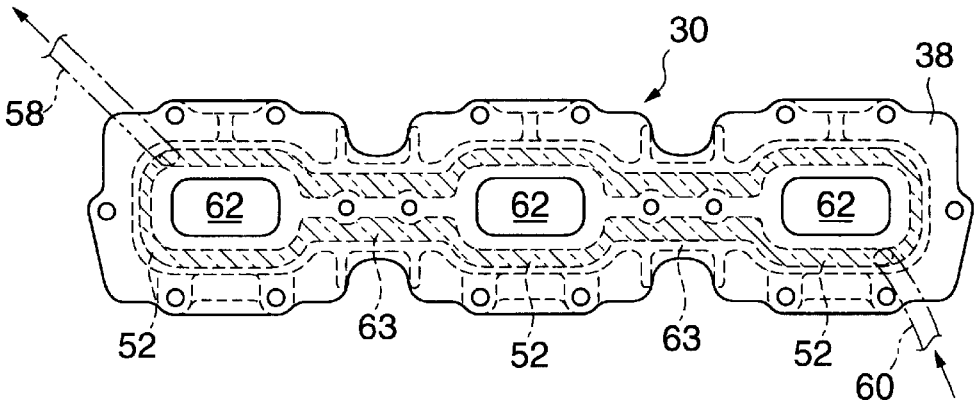
FIG. 5 is a view of an intake manifold taken in the direction of the arrow V in FIGS. 2 and 4.

FIG. 5 shows the water jackets 52 for the intake manifold 30 for three cylinders by way of example. In FIG. 5, the water jackets 52 are shaded with parallel lines, which do not indicate a section, to facilitate the recognition of the water jacket 52. The water jackets 52 surrounding intake passages 62 communicate with each other by means of connecting passages 63. The lower end of the water jacket 52 at one end of the intake manifold 30 is connected to the water jacket 51 (FIG. 3) of the intake port member 29 by the connecting pipe 60. The cooling water discharge pipe 58 is connected to the upper end of the water jacket 52 at the other end of the intake manifold 30.

Referring to FIG. 2, when the engine 11 operates, air taken in through the air intake case 45 flows through the throttle valve 44, the intake passage 62 of the intake manifold 30 and the reed valve 31 placed in the intake port member 29 into the crankcase 18. The air is supplied through the scavenging passage 23 into the cylinder 16.

Referring to FIG. 1, cooling water taken in through the cooling water inlet 56 of the water-jet propulsion unit 8 is supplied through the cooling water pipe 55 into the water jacket 26 of the cylinder 16 (FIG. 2) and the water jacket 51 of the intake port member 29 (FIG. 3). The cooling water supplied to the water jacket 51 of the intake port member 29 flows through the connecting pipe 60 into the water jacket 52 of the intake manifold 30 and is discharged through the cooling water discharge pipe 58.

The cooling water supplied into the water jacket 51 of the intake port member 29 cools the intake port member 29 for a forced cooling to intercept the transfer of heat from the engine 11 to the reed valve 31. Heat of the reed valve 31 is dissipated through the gasket 39 of a highly heat-conductive metal, so that the valve case 32 of the reed valve 31 is cooled by heat conduction. The cooling water supplied into the water jacket 52 of the intake manifold 30 cools the intake manifold 30 for a forced cooling. Heat of the reed valve 31 is dissipated through the gasket 40 of a highly heat-conductive metal, so that the valve case 32 of the reed valve 31 is cooled by heat conduction.

The small planing boat shown in FIG. 1 that uses the ambient water as the cooling water, in contrast with land vehicles that circulate cooling water, is able to use a large amount of low-temperature cooling water for a great cooling effect. Therefore, temperature rise in the reed valve 31 of the two-cycle direct injection engine, which cannot expect the cooling effect of fuel (air-fuel mixture) that flows through the reed valve of an engine provided with a carburetor, can be effectively suppressed by using the ambient water as the cooling water.

Second Embodiment

Figure 6:
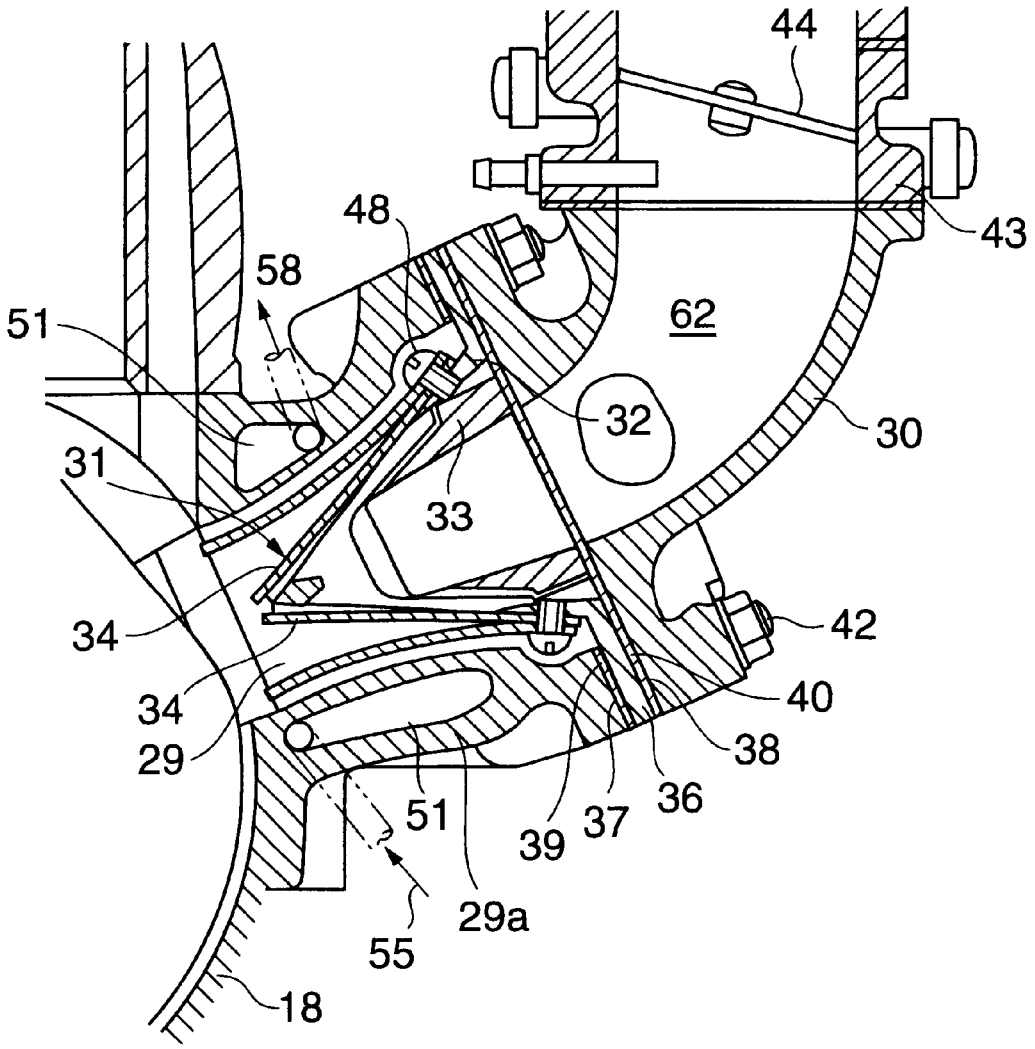
FIG. 6 is an enlarged vertical sectional view, similar to FIG. 3, of a reed valve portion included in an engine provided with a reed valve cooling apparatus in a second embodiment according to the present invention.

A reed valve cooling apparatus in a second embodiment according to the present invention shown in FIG. 6 is similar to the reed valve cooling apparatus in the first embodiment shown in FIG. 3 and hence parts of the second embodiment like or corresponding to those of the first embodiment are denoted by the same reference characters and the description thereof will be omitted.

Referring to FIG. 6, only a water jacket 51 is formed in a circumferential wall 29*a* of an intake port member 29 and the intake manifold 30 is not provided with any water jacket. A gasket 39 of a highly heat-conductive metal is held between the joining surface 37 of the intake port member 29 and the flange 36 of the reed valve 31, as is true with the first embodiment. A gasket 40 of a highly heat-conductive metal is held between the lower joining surface 38 of the intake manifold 30 and the flange 36 of the reed valve 31, as is true with the first embodiment. A cooling water discharge pipe 58 is connected to the upper end of the water jacket 51.

Third Embodiment

Figure 7:
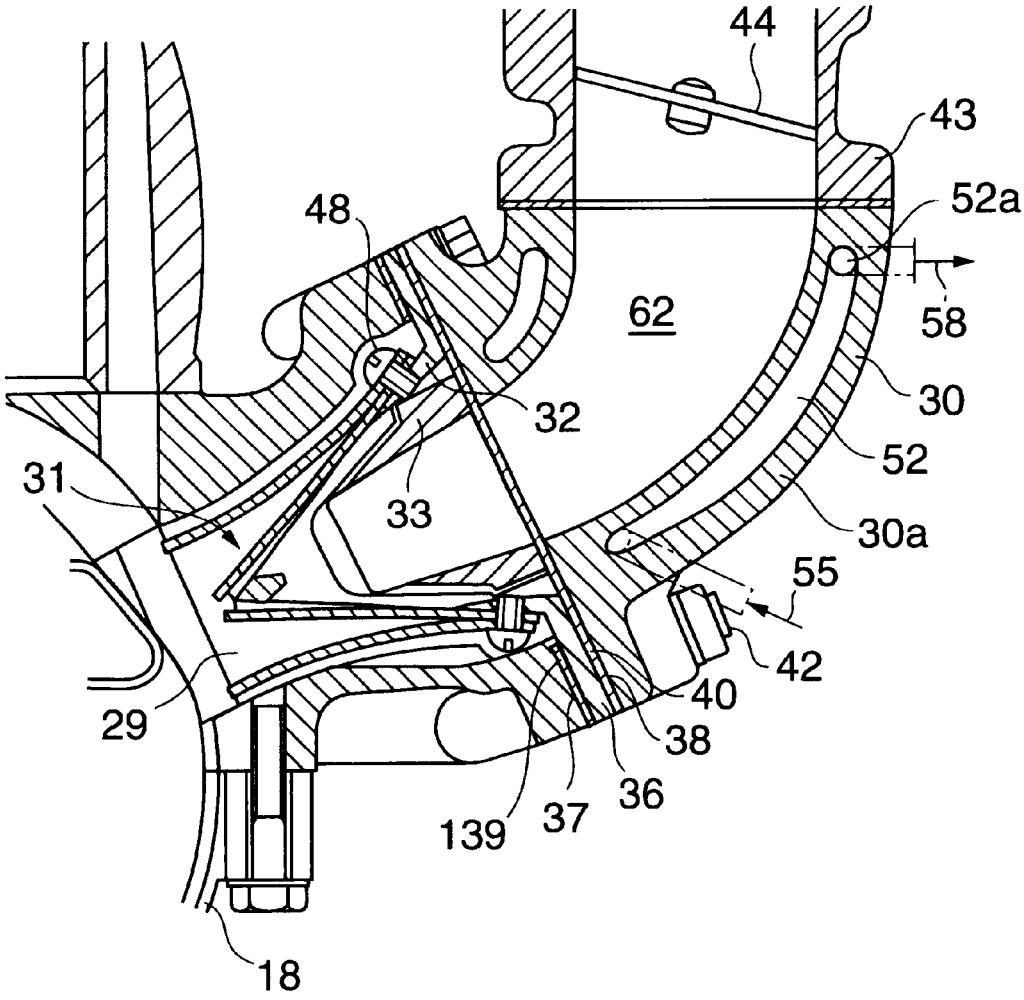
FIG. 7 is an enlarged vertical sectional view, similar to FIG. 3, of a reed valve portion included in an engine provided with a reed valve cooling apparatus in a third embodiment according to the present invention.
Figure 8:
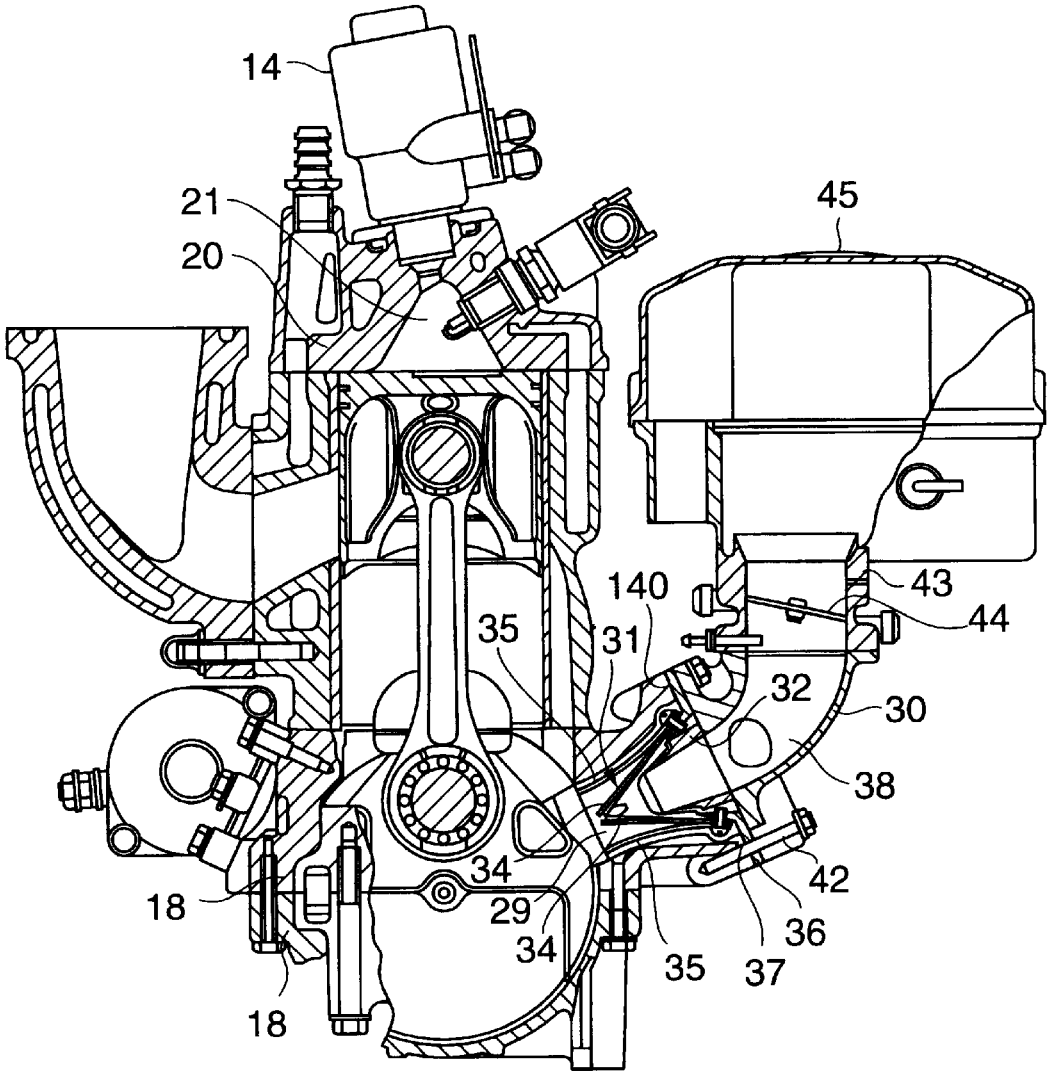
FIG. 8 is a vertical sectional view of a conventional engine.

A reed valve cooling apparatus in a third embodiment according to the present invention shown in FIG. 7 is similar to the reed valve cooling apparatus in the first embodiment shown in FIG. 3 and hence parts of the third embodiment like or corresponding to those of the first embodiment are denoted by the same reference characters and the description thereof will be omitted.

Referring to FIG. 7, only a water jacket 52 is formed in a circumferential wall 30*a* of the intake manifold 30 and the intake port member 29 is not provided with any water jacket. A gasket 40 of a highly heat-conductive metal is held between the joining surface 38 of the intake manifold 30 and the flange 36 of the reed valve 31 to cool the reed valve 31 efficiently. A gasket 139 of a heat-insulating material, such as paper, is held between the joining surface 37 of the intake port member 29 and the flange 36 of the reed valve 31 to prevent the conduction of heat from the crankcase 18 to the reed valve 31. The cooling water discharge pipe 58 is connected to the upper end of the water jacket of the intake manifold 30.

In a structure in which the water jacket 52 is formed only on the intake manifold 30 to cool the reed valve 31, the cast crankcase 18 may be that of the conventional engine, and only the intake manifold may be a modification of the die cast aluminum intake manifold of the conventional engine. Therefore, the manufacturing cost of the engine can be prevented from rising.

Modifications

The cooling water pipe 55 of the reed valve cooling apparatus shown in FIG. 1 is branched into an engine cooling water line and a reed valve cooling water line. However, in FIG. 2, the outlet 52*a* of the water jacket 52 may be connected to the water jacket 26 of the cylinder 16 to use the cooling water used for cooling the reed valve 31 for cooling the cylinder 16 and the cylinder head 20 of the engine 11. In this case, the cooling water may be discharged through the cooling water discharge pipe 58 after cooling the cylinder 16 and the cylinder head 20 of the engine 11.

Although the cooling water is supplied into the water jacket 51 of the intake port member 29 first and then the cooling water flows through the connecting pipe 60 into the water jacket 52 of the intake manifold 30 in the reed valve cooling apparatus shown in FIG. 3, the cooling water may be supplied through the cooling water pipe 55 into the water jacket 52 of the intake manifold 30 first, and the cooling water may flow from the water jacket 52 into the water jacket 51 of the intake port member 29.

In the reed valve cooling apparatus shown in FIG. 7, the heat-insulating gasket 139 of paper may be substituted by a gasket formed of a heat-resistant resin.

Although the invention has been described in terms of the foregoing embodiments as applied to a three-cylinder engine provided with the intake manifold, naturally, the present invention is applicable to a single-cylinder engine provided with another type of an intake pipe instead of the intake manifold.

As apparent from the foregoing description, according to the present invention, the reed valve cooling apparatus for cooling the reed valve 31 fitted in the intake port member 29 formed on the crankcase 18 of the engine 11, and having the flange 36 placed between the joining surface 37 of the intake port member 29 and the joining surface 38 of the intake manifold 30 has the water jacket 51 formed in the circumferential wall 29*a* of the intake port member 29 or the water jacket 52 formed in the circumferential wall 30*a* of the intake manifold 30, or both the water jacket 51 on the intake port member 29 and the water jacket 52 on the intake manifold 30, to cool the reed valve 31 by the cooling water for a forced cooling. Therefore, the reeds 34 do not need to be thick, and reeds 34 have satisfactory response characteristic and sufficient strength.

According to the present invention, the highly heat-conductive gasket 39 is placed between the joining surface 37 of the intake port member 29 and the flange 36 of the reed valve 31 when the water jacket 51 is formed on the intake port member 29. Therefore, heat can be efficiently transferred from the reed valve 31 through the flange 36 and the gasket 39 to the intake port member 29 cooled by the cooling water, so that the reed valve 31 can be efficiently cooled.

According to the present invention, the highly heat-conductive gasket 40 is placed between the joining surface 38 of the intake manifold 30 and the flange 36 of the reed valve 31, and the heat-insulating gasket 139 is placed between the joining surface 37 of the intake port member 29 and the flange 36 of the reed valve 31 when the water jacket is formed only on the intake manifold 30. The reed valve 31 can be effectively cooled by the conduction of heat from the reed valve 31 through the flange 36 and the highly conductive gasket 40 to the intake manifold 30, and the conduction of heat from the intake port member 29 to the reed valve 31 can be effectively retarded by the heat-insulating gasket 39.

According to the present invention, when the water jacket 52 is formed only on the intake manifold 30, the cast crankcase 18 may be that of the conventional engine, and only the die-cast aluminum intake manifold 30 may be a modification of the intake manifold of the conventional engine. Therefore, the manufacturing cost of the engine can be prevented from rising.

When the engine is of an injector type provided with the injector 14 disposed above the reed valve 31 with respect to the flowing direction of intake air or on the cylinder head 20, only air or air containing a small amount of oil flows through the reed valve 31 and the cooling of the reed valve 31 by fuel cannot be expected. When the engine is provided with the reed valve cooling apparatus of the present invention using cooling water, temperature rise in the reed valve 31 can be effectively suppressed and the reeds 34 having satisfactory response characteristic can be used. In the small planing boat that is able to use the ambient water for cooling, the cooling effect of the reed valve cooling apparatus is further improved.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. A reed valve cooling apparatus for cooling a reed valve fitted in an intake port member formed on a crankcase of an internal-combustion engine, the reed valve having a flange placed between a joining surface of the intake port member and a joining surface of an intake pipe, the reed valve cooling apparatus comprising:

a water jacket formed in a circumferential wall of the intake port member;

a highly heat-conductive gasket placed between the joining surface of the intake port member and the flange of the reed valve; and wherein the flange of the reed valve is heat-conductively connected to the joining surface of the intake port via the heat-conductive gasket in order to transfer heat from the reed valve to the intake port cooled by the water jacket via the heat-conductive gasket.

2. The reed valve cooling apparatus according to claim 1, further comprising:

a water jacket formed in a circumferential wall of the intake pipe; and a highly heat-conductive gasket placed between the joining surface of the intake pipe and the flange of the reed valve.

3. The reed valve cooling apparatus according to claim 1, wherein the engine is provided with an injector disposed at a position above the reed valve with respect to a flowing direction of an intake air or on a cylinder head.

4. The reed valve cooling apparatus according to claim 1, wherein the engine is adapted to be installed on a craft for traveling on a water; and wherein a cooling water for the water jacket is supplied from an ambient water.

5. A reed valve cooling apparatus as claimed in claim 1, wherein the highly heat-conductive gasket is a metal gasket.

6. A reed valve cooling apparatus for cooling a reed valve fitted in an intake port member formed on a crankcase of an internal-combustion engine, the reed valve having a flange placed between a joining surface of the intake port member and a joining surface of an intake pipe, the reed valve cooling apparatus comprising:

a water jacket formed in a circumferential wall of the intake pipe;

a highly heat-conductive gasket placed between the joining surface of the intake pipe and the flange of the reed valve;

a heat-insulating gasket placed between the joining surface of the intake port member and the flange of the reed valve; and wherein the flange of the reed valve is heat-conductively connected to the joining surface of the intake pipe via the heat-conductive gasket in order to transfer heat from the reed valve to the intake pipe cooled by the water jacket via the heat-conductive gasket.

7. The reed valve cooling apparatus according to claim 6, wherein the engine is provided with an injector disposed at a position above the reed valve with respect to a flowing direction of an intake air or on a cylinder head.

8. The reed valve cooling apparatus according to claim 6, wherein the engine is adapted to be installed on a craft for traveling on a water; and wherein a cooling water for the water jacket is supplied from an ambient water.

9. The reed valve cooling apparatus as claimed in claim 6, wherein the highly heat-conductive gasket is a metal gasket.

10. The internal-combustion engine comprisint:

a crankcase;

an intake port member formed on the crankcase, the intake port member having a circumferential wall and a joining surface;

an intake pipe joined to the intake port member, the intake pipe having a circumferential wall and a joining surface;

a reed valve fitted in the intake port member, the reed valve having a flange placed between the joining surface of the intake port member and the joining surface of the intake pipe;

a reed valve cooling apparatus having a water jacket formed in the circumferential wall of the intake port member and a highly heat-conductive gasket placed between the joining surface of the intake port member and the flange of the reed valve; and wherein the flange of the reed valve is heat-conductively connected to the joining surface of the intake port via the heat-conductive gasket in order to transfer heat from the reed valve to the intake port cooled by the water jacket via the heat-conductive gasket.

11. The internal-combustion engine according to claim 10, wherein reed valve cooling apparatus further comprising:

a water jacket formed in the circumferential wall of the intake pipe; and a highly heat-conductive gasket place between the joining surface of the intake pipe and the flange of the reed valve.

12. An internal-combustion according to claim 10, further comprising:

a cylinder head; and an injection disposed at a position above the reed valve with respect to a flowing direction of an intake air or on the cylinder head.

13. The internal-combustion engine according to claim 10, wherein the engine is adapted to be installed on a craft for traveling on a water; and wherein a cooling water for the water jacket is supplied from an ambient water.

14. The internal combustion engine as claimed in claim 10, wherein the highly heat-conductive gasket is a metal gasket.

15. An internal-combustion engine comprising:

a crankcase;

an intake port member formed on the crankcase, the intake port member having a circumferential wall and a joining surface;

an intake pipe joined to the intake port member, the intake pipe having a circumferential wall and a joining surface;

a reed valve fitted in the intake port member, the reed valve having a flange placed between the joining surface of the intake port member and the joining surface of the intake pipe;

a reed valve cooling apparatus having a water jacket formed in the circumferential wall of the intake pipe; a highly heat-conductive gasket placed between the joining surface of the intake pipe and the flange of the reed valve; and a heat-insulating gasket placed between the joining surface of the intake port member and the flange of the reed valve; and wherein the flange of the reed valve is heat-conductively connected to the joining surface of the intake port via the heat-conductive gasket in order to transfer heat from the reed valve to the intake port cooled by the water jacket via the heat-conductive gasket.

16. The internal-combustion engine according to claim 15, further comprising:

a cylinder head; and an injector disposed at a position above the reed valve with respect to a flowing direction of an intake air or on the cylinder head.

17. The internal-combustion engine according to claim 16, wherein the engine is adapted to be installed on a craft for traveling on a water; and wherein a cooling water for the water jacket is supplied from an ambient water.

18. The internal combustion engine as claimed in claim 15, wherein the highly heat-conductive gasket is a metal gasket.

* * * * *